US005521691A

United States Patent [19]

Morimoto et al.

[11] Patent Number: 5,521,691

[45] Date of Patent: May 28, 1996

[54] CLEANING DEVICE FOR REMOVING RESIDUAL TONER ON AN IMAGE CARRIER

[75] Inventors: Hiroshi Morimoto; Kazuo Yasuda, both of Hachioji, Japan

[73] Assignee: Konica Corporation, Tokyo, Japan

[21] Appl. No.: 373,641

[22] Filed: Jan. 17, 1995

[30] Foreign Application Priority Data

| | | | |
|---|---|---|---|
| Jan. 20, 1994 | [JP] | Japan | 6-019971 |
| Jan. 25, 1994 | [JP] | Japan | 6-023286 |
| Oct. 6, 1994 | [JP] | Japan | 6-243053 |

[51] Int. Cl.[6] ..... G03G 21/00; G03G 15/01

[52] U.S. Cl. ..... 355/299; 355/326 R

[58] Field of Search ..... 355/299, 326 R, 355/327

[56] References Cited

U.S. PATENT DOCUMENTS 5,115,280 5/1992 Hamada et al. ..... 355/299

FOREIGN PATENT DOCUMENTS 4-335387 11/1992 Japan .

*Primary Examiner*—Joan H. Pendegrass
*Assistant Examiner*—Quana Grainger
*Attorney, Agent, or Firm*—Finnegan, Henderson, Farabow, Garrett & Dunner

[57] ABSTRACT

A cleaning device for use in an image forming apparatus which includes an image carrier, an image forming device to form a toner image on the image carrier, and a transferor to transfer the toner image from the image carrier onto a recording sheet, in which the cleaning device cleans a residual toner on the image carrier after transferring. The cleaning device includes a cleaning blade to scrape off the residual toner on a circumferential surface of the image carrier, a contacting member to bring a tip end of the cleaning blade into contact with the circumferential surface of the image carrier in a direction upstream of a moving direction of the image carrier when a cleaning operation of the blade is conducted, and a releasing member to release the tip end of the cleaning blade from the circumferential surface. The blade is made of an elastic member having a coefficient of dynamic friction between the blade and the image carrier of 0.15 to 0.4.

3 Claims, 7 Drawing Sheets

CLEANING DEVICE FOR REMOVING RESIDUAL TONER ON AN IMAGE CARRIER

BACKGROUND OF THE INVENTION

The present invention relates to a cleaning device by which the surface of the image carrier of an electrostatic copier is cleaned.

In general, a toner image formed on the surface of the image carrier of the electrostatic recording apparatus is not completely transferred onto a recording sheet, and residual toner that has not been transferred is left on the surface of the image carrier. In order to accomplish the successive copying operation, it is necessary to remove this residual toner from the surface of the image carrier for cleaning. In order to achieve the object, there is provided a cleaning device by which the residual toner is scraped off with a blade. In this cleaning device, an end of the blade comes into contact with the image carrier, and the cleaning device is classified into two types, one is a trail system and the other is a counter system. In the trail system, an end of the blade is contacted with the image carrier being set in a downstream direction of the image carrier. In the counter system, the end of the blade is contacted with the image carrier being set in an upstream direction of the image carrier. Since the end of the blade is set in the upstream direction of the image carrier in the counter system, the toner cleaning property of the counter system is superior to that of the trail system.

In this connection, durability of the cleaning device can be improved when the blade is contacted with the image carrier only in the process of cleaning and the blade is separated from the image carrier after the completion of cleaning.

In the color image apparatus, developers of a plurality of colors are used, and processes of charge, exposure and development are repeated so that a color toner image of 3 or 4 colors is formed on the image carrier, and then the formed color toner image is transferred onto a recording sheet at one operation. In this color toner image forming apparatus, the cleaning blade is separated from the image carrier while the color toner image is being formed on the image carrier, and after the completion of transfer of the color toner image, the blade is contacted with the image carrier and residual toner on the image carrier is scraped off for cleaning.

However, in the cleaning device described above in which the blade is used for removing residual toner, the following problems may be encountered and the formed images are stained with residual toner.

In the counter system in which the contact and release means for contacting and releasing an end of the blade is provided, only when the residual toner is removed from the image carrier, the end of the blade comes into contact with the image carrier, and after the completion of cleaning, the blade is separated from the image carrier. In this case, the blade is contacted with the image carrier which is being rotated. At this time of contact of the blade with the image carrier, the blade bounces up.

In the color image apparatus, developers of a plurality of colors are used, and processes of charge, exposure and development are repeated so that a color toner image is formed on the image carrier, and then the formed color toner image is transferred onto a recording sheet at one operation. In this color toner image forming apparatus, the blade frequently bounces up when the blade end is contacted with and released from the image carrier.

When the blade bounces like this, the surface of the image carrier is damaged and sometimes stained by the marks of bounce. The damage and stain may affect the formation of an image on the image carrier, and it is difficult to provide an image of high quality.

When the blade coming into contact with the image carrier is released, residual toner on the blade and image carrier is scattered and deposited on an image formed on the image carrier, so that the formed image becomes defective. In this way, a problem of the spill of toner occurs.

Sometimes, this problem of the spill of toner spreads to a position about 160 mm distant from the blade release position. In order to solve above problem, a surplus portion is provided on the conventional image carrier irrespective of the formation of a toner image, and the scattered toner is deposited on this surplus portion.

However, when this surplus portion is provided on the image carrier, dimensions of the image carrier are increased, and the image carrier occupies a large space in the image forming apparatus, so that it is difficult to downsize the color image forming apparatus. Since the dimensions of the image carrier are increased, it is necessary to raise the moving speed of the image carrier. Accordingly, more precise mechanisms are required for controlling the speed, and the manufacturing cost is increased.

In the case of a cleaning device in which the contact and release of the cleaning means are repeatedly conducted, residual toner is scraped and scattered from the image carrier as illustrated in the schematic illustration of FIG. 10(*a*). Then, as illustrated in the schematic illustration of FIG. 10(*b*), the scattered toner tends to be deposited on a contact surface of the cleaning blade on the downstream side. As a result, the blade surface is gradually stained by the deposited toner.

After the blade has been contacted with the image carrier, the residual toner on the image carrier is removed by the blade. At this time, the latent image still remains on the image carrier and passes through the blade. Therefore, as illustrated in the schematic illustration of FIG. 10(*c*), the toner deposited on the blade surface tends to scatter onto the residual latent image, especially the toner deposited on the blade surface opposed to the image carrier tends to scatter to an edge of the latent image, and the remaining latent image on the image carrier is developed by the scattered toner. In other words, what is called "blade development" is caused.

Conventionally, in order to prevent the occurrence of the blade development, the latent image is discharged by an AC discharger arranged before the blade. According to this AC discharging system, the cost of the apparatus including the electric power supply unit is very high, and further the durability of the wire used for a discharge electrode of corona discharge is low. The above problems may be encountered in the prior art.

SUMMARY OF THE INVENTION

In view of the above problems, the present invention has been achieved. The first object of the present invention is to provide a cleaning device in which the bounce of a cleaning blade can be prevented without deteriorating the cleaning property when the cleaning blade comes into contact with the image carrier. The second object of the present invention is to provide a cleaning device used for a color image forming apparatus in which the cleaning blade is frequently contacted with and released from the image carrier, wherein it is possible to prevent the occurrence of bounce of the cleaning blade without deteriorating the cleaning property when the cleaning blade comes into contact with the image carrier.

The third object of the present invention is to provide a cleaning device in which an amount of the spill of toner is reduced When the cleaning blade is contacted with and released from the image carrier, so that the formation of a defective image can be prevented. The fourth object of the present invention is to provide a cleaning device used for a color image forming apparatus in which the cleaning blade is frequently contacted with and released from the image carrier, wherein it is possible to reduce an amount of the spill of toner especially when the cleaning blade is released from the image carrier, so that the formation of a defective image can be prevented.

The fifth object of the present invention is to provide an inexpensive, stable and positive image forming apparatus capable of forming an image without the occurrence of stain, in which blade development is not made in an image region but blade development is made in a non-image region that is not related to an image formed on the photoreceptor. In this case, the non-image region is necessarily arranged in an electrophotographic color image forming process in which each color image is superimposed on the photoreceptor and transferred onto a recording sheet, for the purpose of suppressing the occurrence of blade development in the image region without using a discharging means.

The first embodiment of the present invention will be described below:

A cleaning device is provided in an image forming apparatus including an image carrier, a toner image forming means for forming a toner image on the image carrier, and a transfer means for transferring the toner image on the image carrier onto a recording sheet. After the toner image on the image carrier has been transferred, the cleaning device conducts cleaning on the image carrier so that residual toner can be removed. The cleaning device comprises a cleaning blade for scraping residual toner on the circumferential surface of the image carrier, a contact means for making an end of the blade to contact with the image carrier in the direction of the upstream of the movement of the image carrier in the case of cleaning, and a release means for releasing the blade from the image carrier so that the end of the blade can be separated from the image carrier. In this case, the blade is made of resilient material, and a coefficient of dynamic friction between the blade and the image carrier is in a range from 0.15 to 0.4.

The second embodiment of the present invention will be described below:

In the first embodiment, in the image forming apparatus, the toner image forming means repeats the processes of charge, exposure and development with respect to a plurality of color developers, so that a color toner image is superimposed and formed on the image carrier, and this color toner image is transferred onto a recording sheet by the transfer means.

This embodiment further includes a control means, which is operated as follows:

While the image forming means is forming a color toner image on the image carrier, the cleaning blade is separated from the image carrier by the action of the release means. After the color toner image on the image carrier has been transferred on a recording sheet by the transfer means, the cleaning blade is contacted with the image carrier by the contact means.

In this first embodiment, consideration is given to the coefficient of dynamic friction between the blade and the image carrier. Material of the blade is determined so that the coefficient of dynamic friction between the blade and the image carrier can be in a range from 0.15 to 0.40. When the coefficient of dynamic friction is not more than 0.15, the cleaning property is deteriorated, and when the coefficient of dynamic friction is not less than 0.40, the blade bounces up when it comes into contact with the image carrier. When the coefficient of dynamic friction between the blade and the image carrier is determined in the above manner, the bounce of the blade can be prevented without the deterioration of cleaning property when the blade comes into contact with the image carrier.

In the second embodiment of the present invention, the color image forming operation is carried out in the following manner:

The blade is frequently contacted with and released from the image carrier by the contact means and the release means in such a manner that the end of the blade is contacted with the image carrier after the transfer of a color toner image onto a recording sheet and that the end of the blade is separated from the image carrier. In this color image forming apparatus, when the material of the blade is determined so that the coefficient of dynamic friction between the blade and the image carrier can be in a range from 0.15 to 0.40, the occurrence of bounce of the blade can be prevented without the deterioration of cleaning property when the blade is contacted with the image carrier.

The third embodiment of the present invention will be described below:

A cleaning device is provided in an image forming apparatus including an image carrier, a toner image forming means for forming a toner image on the image carrier, and a transfer means for transferring the toner image on the image carrier onto a recording sheet. After the toner image on the image carrier has been transferred, the cleaning device conducts cleaning on the image carrier so that residual toner can be removed. The cleaning device comprises a cleaning blade for scraping residual toner on the circumferential surface of the image carrier, a contact means for making an end of the blade to contact with the image carrier in the cleaning, a release means for releasing the blade from the image carrier so that the end of the blade can be separated from the image carrier, and a control means for controlling the release means so that the release speed can be not more than 40 mm/sec when the blade is released.

The fourth embodiment of the present invention will be described below:

In the third embodiment, in the image forming apparatus, the toner image forming means repeats the processes of charge, exposure and development with respect to a plurality of color developers, so that a color toner image is superimposed and formed on the image carrier, and this color toner image is transferred onto a recording sheet by the transfer means.

This embodiment further includes a control means, which is operated as follows:

While the image forming means is forming a color toner image on the image carrier, the cleaning blade is separated from the image carrier by the action of the release means. After the color toner image on the image carrier has been transferred onto a recording sheet by the transfer means, the cleaning blade is contacted with the image carrier by the contact means.

In the third embodiment, the release speed at which the blade is released from the image carrier by the release means is set at a value not more than 40 mm/sec. When the release speed is lowered, residual toner deposited on the blade and a portion of the image carrier where the blade is contacted is not scattered so that an amount of the spill of toner can be reduced. In the image forming apparatus, it is necessary to provide a surplus portion on the surface of the image carrier so that scattered toner can be deposited on the surplus portion irrespective of image formation. However, in this embodiment, length of the surplus portion on the surface of the image carrier can be reduced because an amount of the spill of toner is small.

In the fourth embodiment, the color image forming operation is carried out as follows:

The blade is frequently contacted with and released from the image carrier by the contact means and the release means in such a manner that the end of the blade is contacted with the image carrier after the transfer of a color toner image onto a recording sheet and that the end of the blade is separated from the image carrier. In this color image forming apparatus, the release speed at which the blade is released from the image carrier by the release means is set low. When the release speed is lowered, residual toner deposited on the blade and a portion of the image carrier where the blade is contacted is not scattered so that an amount of the spill of toner can be reduced. Therefore, length of the surplus portion on the surface of the image carrier can be reduced, wherein spilt toner is deposited on the surplus portion irrespective of toner image formation.

The fifth embodiment of the present invention will be described below:

A cleaning device is provided in an image forming apparatus including an image carrier, a toner image forming means for forming a toner image on the image carrier, and a transfer means for transferring the toner image on the image carrier onto a recording sheet. After the toner image on the image carrier has been transferred, the cleaning device conducts cleaning on the image carrier so that residual toner can be removed. The cleaning device comprises a cleaning blade for scraping residual toner on the circumferential surface of the image carrier, a contact means for making an end of the blade to contact with the image carrier, a release means for releasing the blade from the image carrier so that the end of the blade can be separated from the image carrier, and a latent image pattern forming means for forming a latent image pattern at a position where the cleaning means is contacted outside of the image region on the image carrier.

The sixth embodiment will be described below:

In the image forming apparatus of the fifth embodiment, the toner image forming means carries out the processes of charge, exposure and development with respect to a plurality of colors, and a color toner is formed on the image carrier. This color toner image is transferred onto a recording sheet by the transfer means. This embodiment further includes a control means, which is operated as follows:

While the image forming means is forming a color toner image on the image carrier, the cleaning blade is separated from the image carrier by the action of the release means. After the color toner image on the image carrier has been transferred onto a recording sheet by the transfer means, the cleaning blade is contacted with the image carrier by the contact means.

The seventh embodiment will be described below: In the fifth embodiment, the maximum potential difference of the latent image pattern is not less than 200 V. In other words, the absolute value of a difference between a DC bias voltage ($V_{DC}$) and a potential ($V_L$) on the image carrier after exposure thereof is not less than 200 vols ($|V_{DC}-V_L| \geqq 200$ V).

The eight embodiment will be described below:

In the fifth embodiment, it is controlled that a transfer potential is not impressed upon the latent image pattern by the transfer means.

The ninth embodiment will be described below:

In the fifth embodiment, the toner image forming means further includes a a charge means for charging the image carrier, an exposure means for exposing the image carrier so that a latent image can be formed on the charged image carrier, and a development means for developing the latent image on the image carrier with toner. The latent image pattern forming means writes a pattern predetermined by the exposure means on the image carrier.

In the above fifth to ninth embodiments, a non-image region on the photoreceptor which has no relation to image formation is used. A latent image is written in the non-image region, and the cleaning means is made to come into pressure contact with the surface of the photoreceptor, and toner deposited on the edge of the blade is made to scatter to the latent image pattern formed in the non-image region, and then the latent image is subjected to blade development. Accordingly, when the image region arrives at the edge of the blade, the toner deposited at the edge of the blade has already scattered. Therefore, blade development does not occur in the image region.

DETAILED DESCRIPTION OF THE PREFERRED EMBODIMENT

Figure 1:
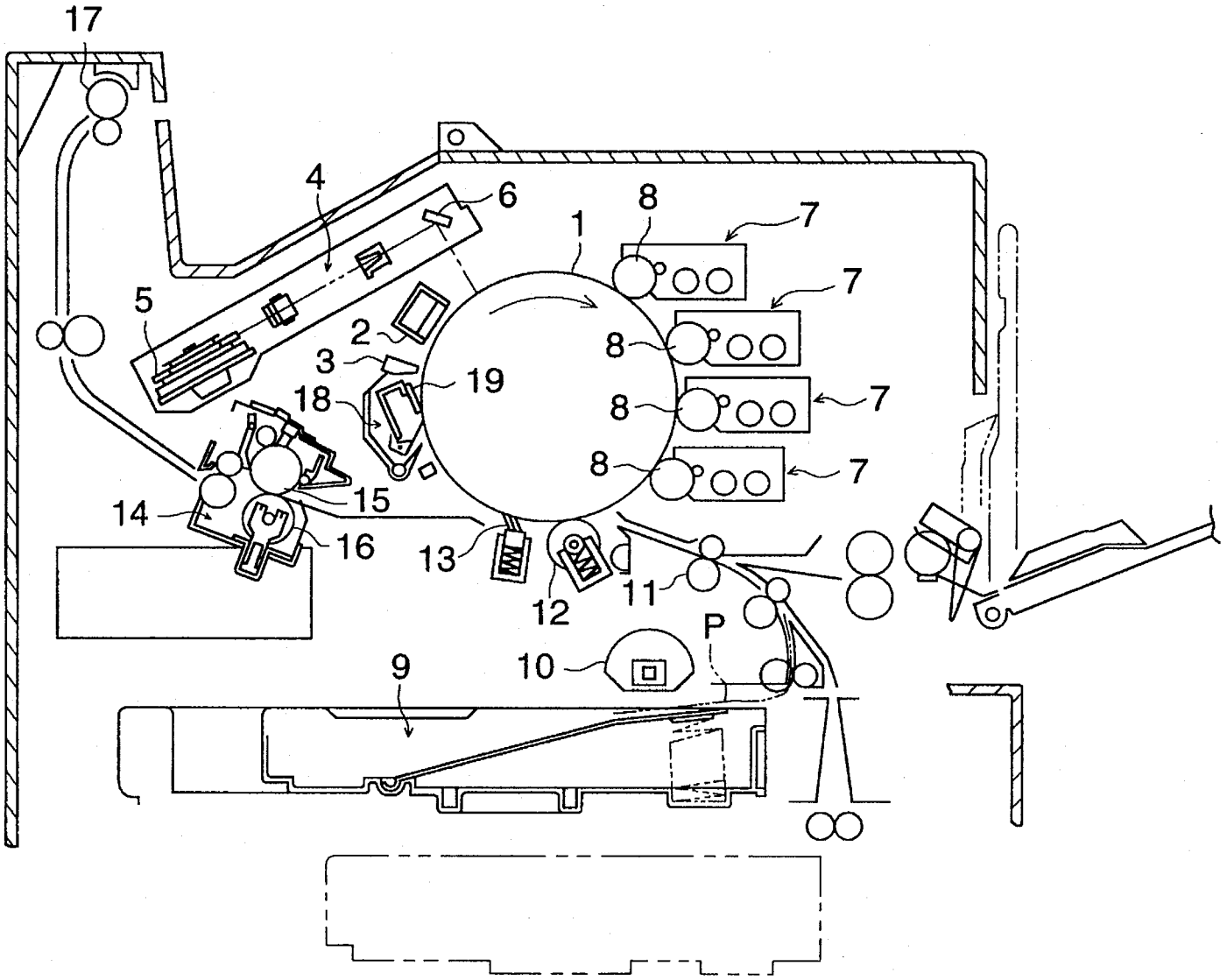
FIG. 1 is sectional arrangement view of the color image forming apparatus.

With reference to the accompanying drawings, an example of the cleaning device of the present invention will be explained as follows. Previously to the explanation of the example of the present invention, the construction and operation of the color image forming apparatus to which the cleaning device of the present invention is applied will be explained with reference to FIG. 1. FIG. 1 is a sectional arrangement view of the color image forming apparatus.

The photoreceptor drum 1, which is an image carrier, is constructed in such a manner that an OPC photoreceptor is coated on the surface of a drum. The photoreceptor drum 1 is rotated clockwise. The charging unit 2 is arranged being opposed to the photoreceptor drum 1. By the charging unit 2, a circumferential surface of the photoreceptor drum 1 is uniformly charged to the electric potential of $V_H$. In this case, corona charging is carried out by the grid, the electric potential of which is maintained at $V_G$, and the corona charging wire. Previously to the charging carried out by the charging unit 2, in order to erase the hysteresis of the photoreceptor, the photoreceptor surface is exposed to light emitted by PCL3 in which the light emitting diode is used, so that the circumferential surface of the photoreceptor is electrically discharged. After the photoreceptor has been uniformly charged, image exposure is conducted on the photoreceptor by the image exposure means 4. The image exposure means 4 is operated as follows. A laser diode not shown in the drawing is used as a light emitting source. Emitted light is sent to the rotational polygonal mirror 5 and passes through the reflecting mirror 6 so that the optical path of the light beam is curved. In this way, the scanning operation is conducted, and a latent image is formed on the photoreceptor drum 1 when it is rotated by one revolution (subsidiary scanning).

Around the photoreceptor drum 1, there is provided developing units 7 respectively having developer containing nonmagnetic insulating toners of yellow (Y), magenta (M), cyan (C) and black (K) and also having magnetic carrier. First, development of the first color is conducted by the rotational developer carrier 8 having a magnet, wherein developer is held on the surface of the developer carrier 8 in the process of development. Developer contains: magnetic carrier, the core of which is made of ferrite, and the core is coated with insulating resin; and nonmagnetic toner primarily made of polyester, and pigment, charge controlling agent, silica and titanium oxide are added to the toner. Developer is provided on the developer carrier 8. While the thickness of the developer layer is regulated to be 100 to 600 μm, developer is conveyed to the developing region by the developer carrier 8. In the developing region, a gap formed between the developer carrier 8 and the photoreceptor drum 1 is maintained to be 0.2 to 1.0 mm which is larger than the thickness of the developer layer. In this gap, AC bias of $V_{AC}$ and DC bias of $V_{DC}$ are impressed being superimposed. The polarity of $V_{DC}$ and that of $V_H$ are the same, and nonmagnetic insulating toner is electrically charged into the same polarity. Accordingly, nonmagnetic insulating toner is released from magnetic carrier by the action of $V_{AC}$, and is not deposited on a portion of $V_H$, the electric potential of which is higher than $V_{DC}$, but nonmagnetic insulating toner is deposited on an exposed portion of $V_L$ on the photoreceptor, the electric potential of which is lower than $V_{DC}$. In this way, the latent image is made to be visual, that is, reversal development is carried out. After the first color image has been made to be visual, image formation of the second color is started, and the photoreceptor drum is uniformly charged again by the scorotron charger 2, and a latent image of the second color is formed by the image exposure means 4. In this case, the discharging operation conducted by PCL3 in the image forming process of the first color is not carried out, because nonmagnetic insulating toner deposited on the image portion of the first color scatters when the electric potential in the surroundings is suddenly lowered.

In this way, the overall circumferential surface of the photoreceptor drum 1 is electrically charged to be the potential of $V_H$. In a portion of the photoreceptor drum surface where the first color image is not formed, a latent image is formed and developed in the same manner as that of the first color. When a portion where the first color image has already been formed is developed, exposure light is shaded by the nonmagnetic insulating toner of the first color that has already been deposited. Due to the aforementioned shading and the electric charge of nonmagnetic insulating toner itself, a latent image of $V_M'$ is formed, and development is conducted in accordance with the difference of electrical potential between $V_{DC}$ and $V_M'$. In this portion where the first and second colors are superimposed, when the first color latent image of $V_L$ is developed, the first and second colors are not well-balanced. In order to solve the above problem, an amount of exposure of the first color is reduced so as to provide an intermediate potential of $|VH|>|V_M|>|V_L|$. With respect to the third and fourth colors, the same image formation process as that of the second color is carried out, so that visual images of 4 colors are formed on the circumferential surface of the photoreceptor drum 1.

Recording sheet P is conveyed out from the sheet feed cassette 9 by the semicircular roller 10. After that, the recording sheet P is temporarily stopped and sent to the transfer region by the sheet feed roller 11 in timed relationship with the transfer. In the transfer region, the transfer roller 12 comes into pressure contact with the circumferential surface of the photoreceptor drum 1 in timed relationship with the transfer, and then a multi-color image is transferred onto the recording sheet P by one operation.

Next, the recording sheet P is discharged by the separation brush 13 which has come into pressure contact with the recording sheet P approximately at the same time. Then the recording sheet P is separated from the circumferential surface of the photoreceptor drum 1 and conveyed to the fixing unit 14, and nonmagnetic insulating toner is fused by the heat and pressure of the heat roller 15 and pressure roller 16. After that, the recording sheet P is discharged to the outside of the apparatus by the sheet discharge roller 17.

In this connection, the transfer roller 12 and separation brush 13 are withdrawn from the circumferential surface of the photoreceptor drum 1 in preparation for the next toner image formation after the recording sheet P has passed. On the other hand, after the recording sheet P has been separated from the photoreceptor drum 1, the blade 19 of the cleaning device 18 comes into pressure contact with the photoreceptor drum 1, so that the residual toner is removed. After the cleaning has been completed, the photoreceptor drum is discharged by PCL3 and charged by the charging unit 2 in preparation for the next image formation. In this connection, immediately after the surface of the photoreceptor drum has been cleaned, the blade 19 is moved so that the blade 19 is withdrawn from the circumferential surface of the photoreceptor drum 1.

Figure 2:
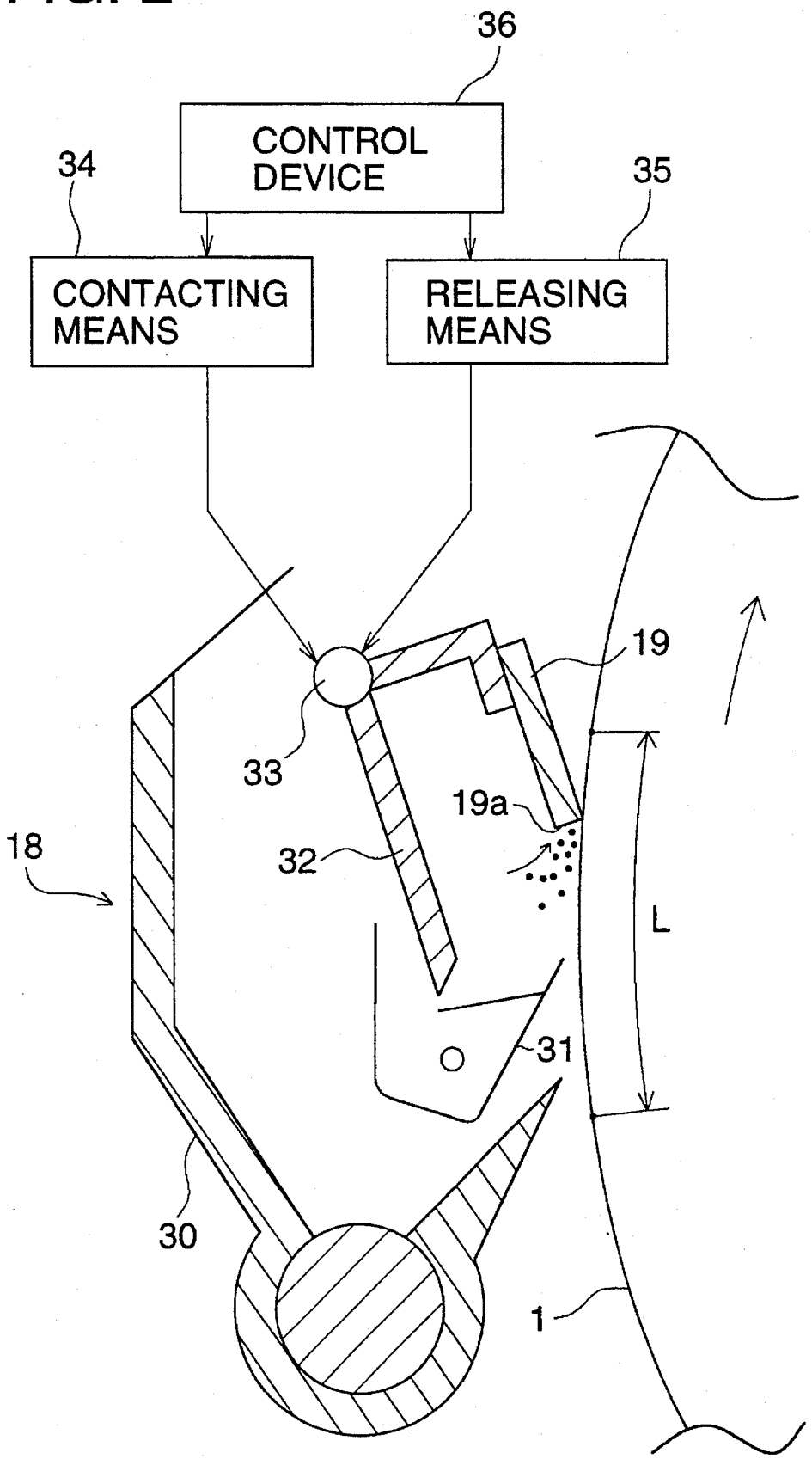
FIG. 2 is a sectional view of the cleaning device.

Next, with reference to FIG. 2, the construction of the cleaning device of the present invention will be explained as follows. FIG. 2 is a sectional view of the cleaning device. The cleaning device 18 is arranged being opposed to the photoreceptor drum 1. A receiving container 31 for receiving residual toner scraped off from the photoreceptor drum 1 is arranged in the casing 30. A blade 19 is arranged above the receiving container 31 while the blade 19 is attached to the support member 32. This support member 32 is mounted on the rotatable drive shaft 33.

The blade 19 supported by the support member 32 is moved to the arrowed direction when the drive shaft 33 is rotated. Therefore, an end 19*a* of the blade 19 comes into contact with the photoreceptor drum 1 in the upstream direction in the process of cleaning. After the completion of cleaning, the end 19*a* of the blade 19 is separated from the photoreceptor drum 1, that is, the blade 19 is released from the photoreceptor drum 1.

The drive shaft 33 is driven by the contact means 34 and the release means 35. These contact and release means 34 and 35 are controlled by the control means 36. The control means 36 controls the entire color image forming apparatus. The image forming operation is carried out in the following manner: Processes of charge, exposure and development are repeated using developers of a plurality of colors, and a color toner image is formed on the photoreceptor drum 1. After this color toner image has been transferred onto a recording sheet, the contact means 34 is controlled so that the end 19*a* of the blade 19 comes into contact with the photoreceptor drum 1, and residual toner on the circumferential surface of the photoreceptor drum 1 is scraped off from the photoreceptor drum 1. In this way, the circumferential surface of the photoreceptor drum 1 is cleaned. In the processes of charge, exposure and development, the release means 35 is controlled, and the end 19*a* of the blade 19 is separated and released from the photoreceptor drum 1.

The blade 19 is made of resilient material, and the coefficient of dynamic friction between the blade 19 and the photoreceptor drum 1 is in a range from 0.15 to 0.4. The coefficient of dynamic friction is defined as a ratio of the frictional force generated on the contact surface relatively moving under a dynamic frictional condition, to the force applied in the direction of a normal line. In this example, consideration is given to the coefficient of dynamic friction between the blade 19 and the photoreceptor drum 1. Material of the blade 19 is determined so that the coefficient of dynamic friction between the blade 19 and the photoreceptor drum 1 can be in a range from 0.15 to 0.40. When the coefficient of dynamic friction between the blade 19 and the photoreceptor drum 1 is determined in the above manner, the bounce of the blade 19 can be prevented without the deterioration of cleaning property when the blade 19 comes into contact with the photoreceptor drum 1.

In the color image forming operation, the blade 19 is frequently contacted with and released from the photoreceptor drum 1 by the contact means 34 and the release means 35 in such a manner that the end 19*a* of the blade 19 is contacted with the photoreceptor drum 1 after the transfer of a color toner image onto a recording sheet and that the end 19*a* of the blade 19 is separated from the photoreceptor drum 1. In this color image forming apparatus, when the material of the blade 19 is determined so that the coefficient of dynamic friction between the blade 19 and the photoreceptor drum 1 can be in a range from 0.15 to 0.40, the occurrence of bounce of the blade 19 can be prevented without the deterioration of cleaning property when the blade 19 is contacted with the photoreceptor drum 1.

Figure 3:
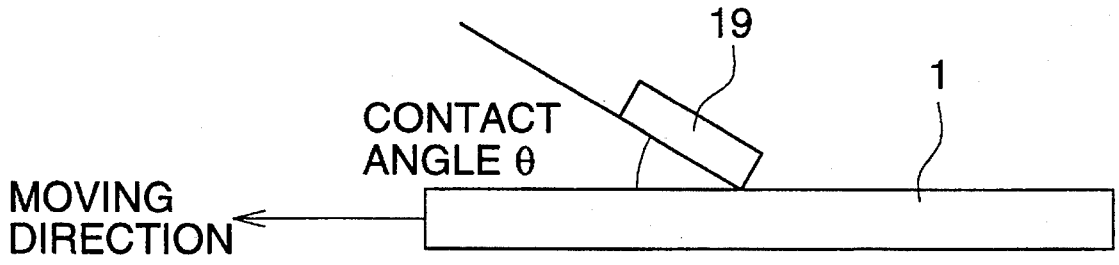
FIG. 3 is an arrangement view of the blade and photoreceptor drum by which the coefficient of dynamic friction is measured.

Next, a more specific example will be explained as follows. The blade 19 and the photoreceptor drum 1 were arranged as illustrated in FIG. 3. The coefficient of dynamic friction was measured using the following measuring apparatus.

Surface measuring apparatus manufactured by Heidon Co.

Type Heidon-14S/D

The measuring conditions were determined as follows: Contact angle θ between the blade 19 and the photoreceptor drum 1 is 30°. The load given in the direction of a normal line direction is 30 g/cm. The moving speed of the photoreceptor drum 1 is 100 mm/min.

The surface measuring apparatus of type Heidon-14S/D manufactured by Heidon Co. was used for measuring the coefficient of dynamic friction. The blade 19 was made of resilient urethane rubber, the coefficients of dynamic friction of which are shown on Table 1.

TABLE 1

| Blade | Coefficient of dynamic friction |
|---|---|
| A | 0.29 |
| B | 0.40 |
| C | 0.48 |
| D | 0.50 |
| E | 0.50 |
| F | 0.54 |

Using this blade 19 to which a resilient member made of urethane rubber is applied, a bounce test was made. The method of the test is described below. While the photoreceptor drum 1 was being rotated at the speed of 100 mm/sec, the blade 19 was contacted with the photoreceptor drum 1 for 10 seconds. After that, the blade 19 was released from the photoreceptor drum 1 for 5 seconds. The above contact and release operation was repeated for 120 minutes. When the bounce of the blade 19 was detected, it was represented by the mark X, and when the bounce of the blade 19 was not detected, it was represented by the mark ○. Evaluation of the bounce was made by the sound and the trail of the blade 19 left on the photoreceptor drum 1.

TABLE 2

| Blade | A | B | C | D | E | F |
|---|---|---|---|---|---|---|
| Bounce | O | O | X | X | X | X |

In the same manner as that of the previous test, the surface measuring apparatus of type Heidon-14S/D manufactured by Heidon Co. was used for measuring the coefficient of dynamic friction. The blade 19 was made of resilient fluorine-contained rubber, the coefficients of dynamic friction of which are shown on Table 3.

TABLE 3

| Blade | Coefficient of dynamic friction |
|---|---|
| G | 0.12 |
| H | 0.15 |
| I | 0.23 |

The bounce test was conducted on the blade 19 made of resilient fluorine-contained rubber. The test method was the same as that of the bounce test of the blade made of urethane robber. In the test of the blade 19 made of resilient fluorine-contained rubber, there was no bounce at all, so that the marks of ○ are shown on Table 4. Evaluation of the bounce was made by the sound and the trail of the blade 19 left on the photoreceptor drum 1.

TABLE 4

| Blade | G | H | I |
|---|---|---|---|
| Bounce | O | O | O |

The blades made of urethane rubber or fluorine-contained rubber which were not bounced in the bounce test were assembled to the color image forming apparatus of type DC9028 manufactured by Konica Co. In this test, the bouncing and cleaning properties were checked, and the results of the test are shown on Table 5.

TABLE 5

| | Urethane rubber | | Fluorine-contained rubber | | |
|---|---|---|---|---|---|
| Blade | A | B | G | H | I |
| Bounce | O | O | O | O | O |
| Cleaning Property | O | O | X | O | O |

As can be seen from Table 5, the best result was provided by the blade 19, the coefficient of dynamic friction of which was 0.15 to 0.40, in which there was not bounce and the cleaning property was high.

As described above, in the first embodiment of the present invention, consideration is given to the coefficient of dynamic friction between the blade and the image carrier. Material of the blade is determined so that the coefficient of dynamic friction between the blade and the image carrier can be in a range from 0.15 to 0.40. At this time, the impact resilience of the blade is 14 to 30% at 23° C. and 50%RH. When the coefficient of dynamic friction is determined in the above manner, the bounce of the blade can be prevented without the deterioration of cleaning property when the blade comes into contact with the image carrier.

In the second embodiment of the present invention, the blade is frequently contacted with and released from the image carrier by the contact means and the release means in such a manner that the end of the blade is contacted with the image carrier after the transfer of a color toner image onto a recording sheet and that the end of the blade is separated from image carrier. In this color image forming apparatus, when the material of the blade is determined so that the coefficient of dynamic friction between the blade and the image carrier can be in a range from 0.15 to 0.40, the occurrence of bounce of the blade can be prevented without the deterioration of cleaning property when the blade is contacted with the image carrier.

Next, an example of the present invention for accomplishing the third and fourth object will be explained below.

In FIG. 2, the release speed at which the blade 19 is released from the photoreceptor drum 1 by the release means 35 is set at a value not more than 40 mm/sec. When the release speed is lowered, residual toner deposited on the blade 19 and a portion of the photoreceptor drum 1 where the blade 19 is contacted is not scattered so that an amount of the spill of toner can be reduced. In the image forming apparatus, it is necessary to provide a surplus portion on the surface of the photoreceptor drum so that scattered toner can be deposited on the surplus portion irrespective of image formation. However, in this example, length L of the surplus portion on the surface of the photoreceptor drum 1 can be reduced because an amount of the spill of toner is small.

Since length L of the surplus portion on the photoreceptor drum surface can be reduced as described above, it is possible to reduce the diameter of the photoreceptor drum 1. Accordingly, the photoreceptor drum 1 can be assembled into a small space, and the entire color image forming apparatus can be downsized. Since the photoreceptor drum 1 can be made compact, it is not necessary to increase the rotational speed of the photoreceptor drum 1 in order to make up for the surplus portion. Therefore, the mechanism and control of the apparatus can be simplified, and an increase in the cost can be prevented.

In the color image forming operation, the blade 19 is frequently contacted with and released from the photoreceptor drum 1 by the contact means 34 and the release means 35 in such a manner that the end 19*a* of the blade 19 is contacted with the photoreceptor drum 1 after the transfer of a color toner image onto a recording sheet and that the end 19*a* of the blade 19 is separated from the photoreceptor drum 1. In this color image forming apparatus, the release speed at which the blade 19 is released from the photoreceptor drum 1 by the release means 35 is set at a value not more than 40 mm/sec. When the release speed is lowered, residual toner deposited on the blade 19 and a portion of the photoreceptor drum 1 where the blade 19 is contacted is not scattered so that an amount of the spill of toner can be reduced.

Figure 4:
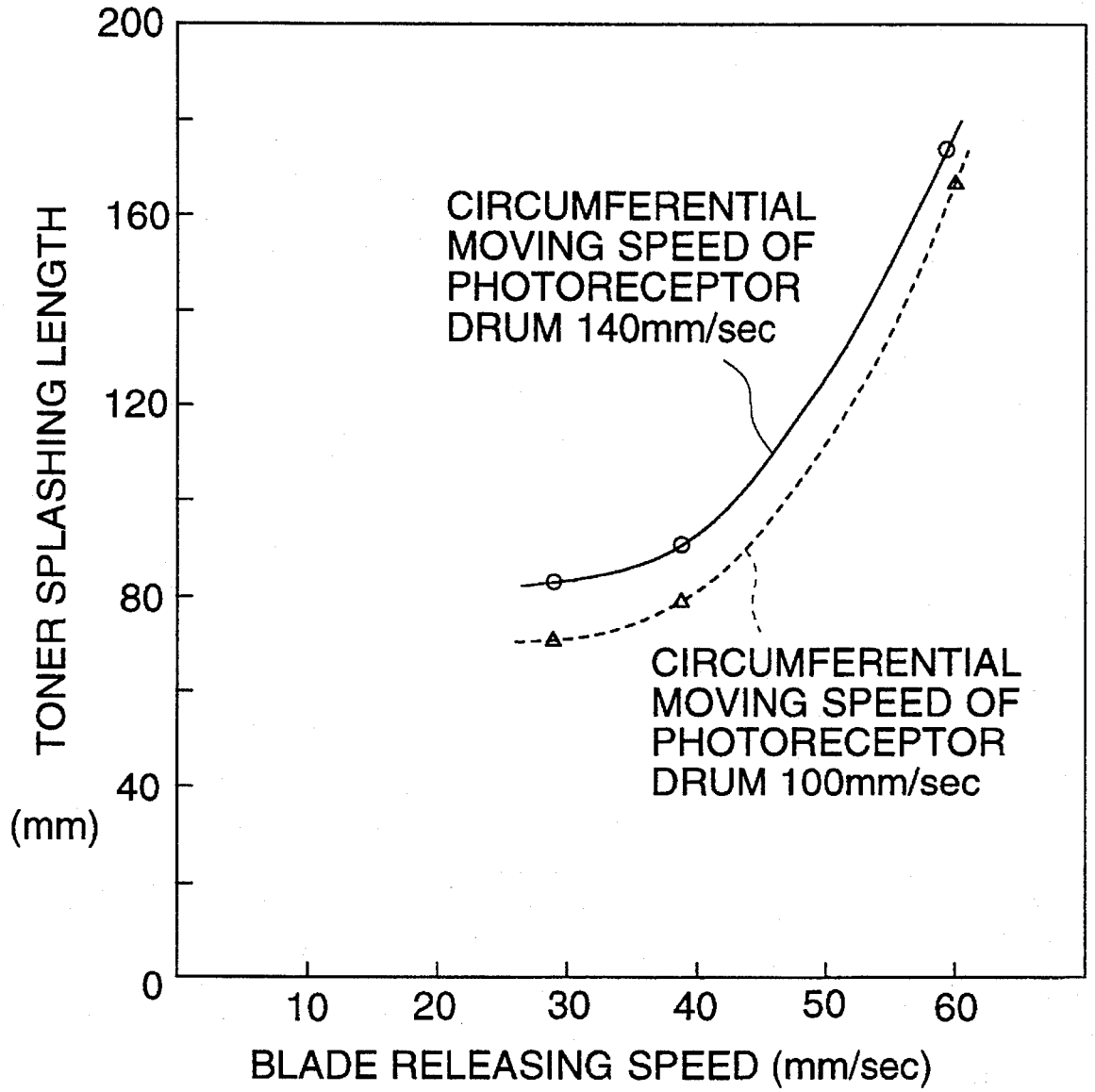
FIG. 4 is a graph showing a relation between the blade release speed and the length of toner spill.

Next, a more specific example will be explained below. Using a color image forming apparatus, color images were actually formed, and a relation between the release speed of the blade 19 and the length of the spill of toner was investigated. The results are shown on FIG. 4. In this case, the length of the spill of toner is the length of a toner portion deposited on the surface of the photoreceptor drum 1. This length was visually checked in the test. As can be seen from FIG. 4, the length of the spill of toner is a little different according to the moving speed of the photoreceptor drum 1. However, the length of the spill of toner is greatly dependent upon the release speed of the blade 19. When the release speed of the blade 19 is not less than 40 mm/sec, the length of the spill of toner is sharply increased. When the release speed of the blade 19 is lowered to be a value not more than 40 mm/sec, the length of the spill of toner is shortened and becomes approximately constant.

In the case of a color image forming apparatus, the normal blade releasing speed was approximately 60 mm/sec. When the releasing speed was determined to a value not more than 40 mm/sec, the length of the spill of toner was reduced to a half.

Accordingly, the diameter of the photoreceptor drum of the color image forming apparatus was 180 mm, and the circumferential length of the photoreceptor drum was 565 mm. Since the length of a recording sheet of A4, which is the maximum size, is 429 mm, the length of the surplus portion on the photoreceptor drum is 145 mm. Accordingly, the length of the spill of toner is reduced approximately half, that is, the length of the spill of toner is 72.5 mm. Therefore, the diameter of the photoreceptor drum is (565−72.5)/E=156 mm, and the installation space of the photoreceptor drum is reduced, so that the photoreceptor drum can be easily assembled to the apparatus, and the entire color image forming apparatus can be made compact.

As described above, according to the third embodiment of the present invention, the release speed at which the blade was released from the image carrier was lowered and set at a value not more than 40 mm/sec. Therefore, the residual toner on the blade surface coming into contact with the image carrier is prevented from scattering, and an amount of the spill of toner can be reduced. In the image forming apparatus, it is necessary to provide a surplus portion on the surface of the photoreceptor drum so that scattered toner can be deposited on the surplus portion irrespective of image formation. However, in this example, length of the surplus portion on the surface of the photoreceptor drum can be reduced because an amount of the spill of toner is small. Accordingly, the photoreceptor drum can be easily assembled into a small space of the apparatus, and the entire color image forming apparatus can be made compact. Since the image carrier can be made compact, it is not necessary to increase the rotational speed of the image carrier in order to make up for the surplus portion. Therefore, the mechanism and control of the apparatus can be simplified, and an increase in the cost can be prevented.

According to the color image forming apparatus of the fourth embodiment of the present invention, in the color image forming in which the blade is frequently contacted with and released from the image carrier, the blade release speed is lowered, so that Therefore, the residual toner on the blade surface coming into contact with the image carrier is prevented from scattering, and an amount of the spill of toner can be reduced. In the image forming apparatus, it is necessary to provide a surplus portion on the surface of the photoreceptor drum so that scattered toner can be deposited on the surplus portion irrespective of image formation. However, in this example, length of the surplus portion on the surface of the photoreceptor drum can be reduced because an amount of the spill of toner is small.

Next, an example for accomplishing the fifth object will be described below.

Figure 5:
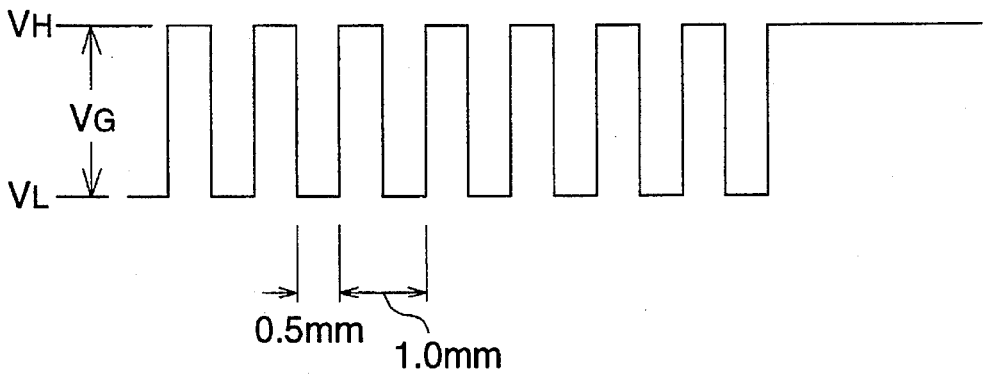
FIG. 5 is a schematic illustration showing an electric potential gap of the latent image pattern on the photoreceptor drum.

In the present invention, as illustrated in FIG. 5, the image and non-image regions on the photoreceptor drum 1 are uniformly charged by the charger 2, and a latent image pattern is formed by the image exposure means 4 in the non-image region on the external circumferential surface of the photoreceptor drum 1. In this case, the latent image pattern is formed on a portion of the photoreceptor drum 1, and the circumferential length of the portion is 20 mm. Concerning the latent image pattern, the size of the line is 0.5 mm, and the interval between the lines is 0.5 mm. As described above, blade development tends to occur in the edge portion of a latent image, and this characteristic is utilized as follows. In order to make the toner on the blade to adhere onto the photoreceptor drum as much as possible, it is preferable to form a latent image pattern, the edge portion of which is large. VH is maintained at a constant value of −750 V, and $V_L$ is changed. In this way, electric potential gap $V_{GAP}$ ($V_{GAP}=|V_H-V_L|$) is changed.

There is provided a mechanism by which the cleaning blade 19 is contacted with and released from the external circumferential surface of the photoreceptor. Controlling operation is carried out in such a manner that the start of contact of the cleaning blade 19 with the photoreceptor drum 1 coincides with a fore end portion of the latent image pattern in the non-image region. Consequently, blade development occurs in the aforementioned latent image pattern portion, but it does not occur in the image region. In the present invention, a test was made using the aforementioned device. Results of the test will be described as follows.

Figure 6:
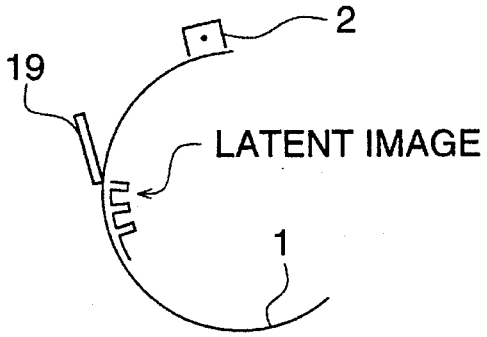
FIG. 6 is a schematic illustration showing a condition of contact between the latent image pattern on the photoreceptor and the cleaning blade.

In this test, 100 sheets of recording paper of the size of A3 were subjected to printing, and the fore end of the cleaning blade was stained. Under this condition, as illustrated in FIG. 6, the cleaning blade 19 was made to come into pressure contact with the external circumferential surface of the photoreceptor, and the latent image patten was made to pass through the blade. Under the above condition, the existence of blade development was checked.

Results of the test are shown on Table 6.

TABLE 6

| Potential gap ($V_G$) | 100V | 200V | 300V | 400V | 500V | 600V |
|---|---|---|---|---|---|---|
| | 100V | 200V | 300V | 400V | 500V | 600V |
| Blade development | Not generated | Generated | Generated | Generated | Generated | Generated |

As a result of the test, it was confirmed that blade development occurred when the electric potential gap $V_G$ was increased to a value not less than 200 V.

Next, a relation between the electric potential gap $V_G$ and the generation distance of blade development was investigated.

Figure 7:
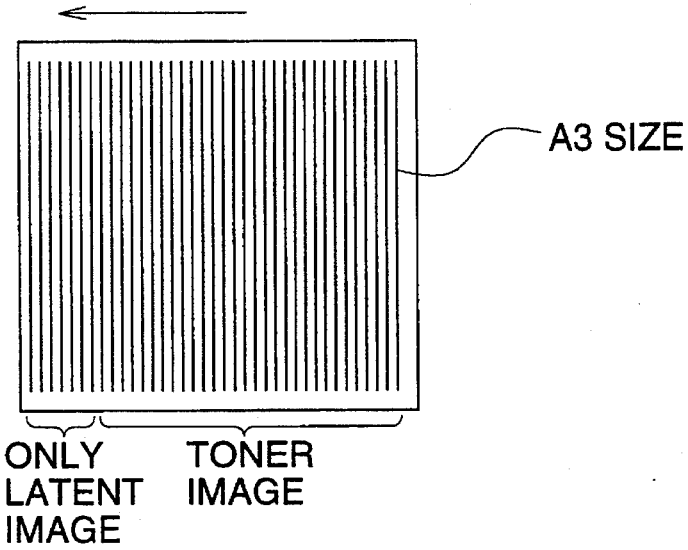
FIG. 7 is a development view of the latent image pattern on the photoceptor.

As illustrated in the development view of FIG. 7, the investigation was made in the following manner. On the external circumferential surface of the photoreceptor of the electrophotographic color image forming apparatus of the present invention, latent image lines, the size of which was approximately 3 dots under the condition of 600 dpi, that is, the size was approximately 130 μm, were written in a region, the size of which was approximately A3, at intervals of 1 mm. A fore end portion of the latent image, the area of which was about ⅕ of the overall latent image, was not developed.

The cleaning blade was controlled in such a manner that the contact of the cleaning blade with the photoreceptor started at the fore end of the line image, and printing was conducted on 1000 sheets of recording paper P. Under the above condition, the generation distance of blade development from the contact position was measured.

In this test, the electric potential gap $V_G$ was set at 200 V, 300 V and 600 V, and 1000 sheets of recording paper were subjected to printing at each electric potential gap.

The maximum generation distance of blade development from the blade contact position was measured, and the results are shown on Table 7.

TABLE 7

| Potential gap $V_G$ | 200V | 300V | 600V |
|---|---|---|---|
| Generation distance of blade development from contact position | 65 mm | 60 mm | 15 mm |

In the above test, the following were confirmed. The larger the electric potential gap VG was, the shorter the generation distance of blade development was reduced.

On the basis of the results shown on Tables 6 and 7, the following operational suitability test was made.

Figure 8:
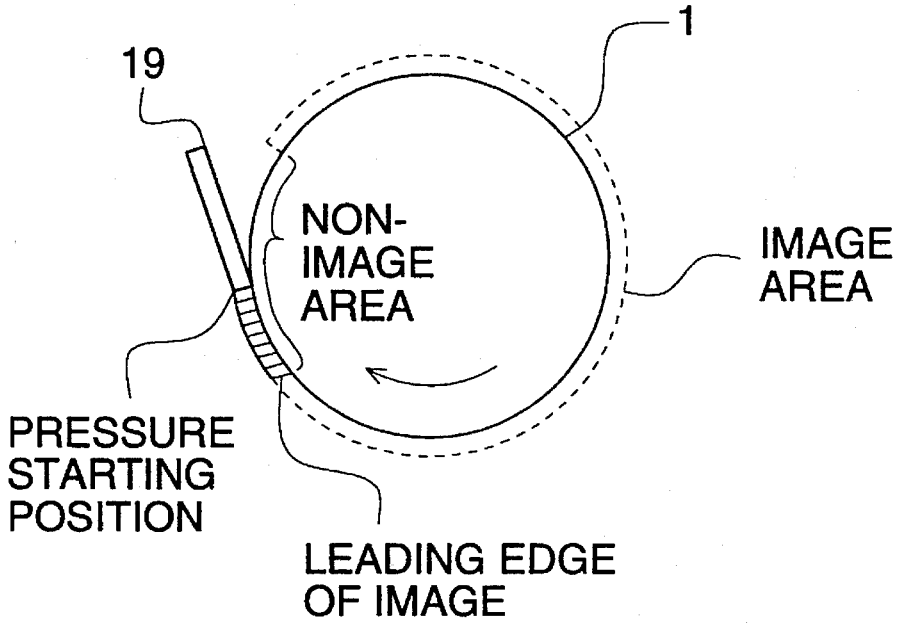
FIG. 8 is a side view showing a relation between the image and non-image regions the cleaning blade.
Figure 9:
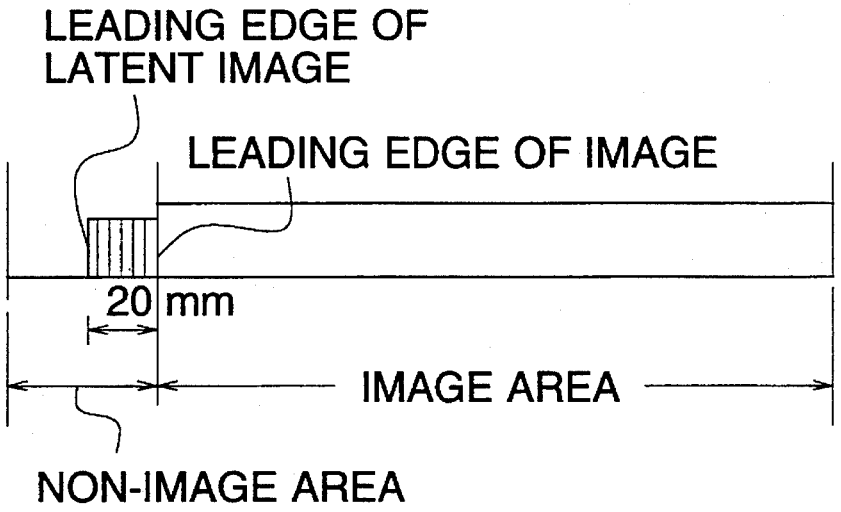
FIG. 9 is an electric charging diagram in the image and no-image region the photoreceptor dry.
Figure 10:
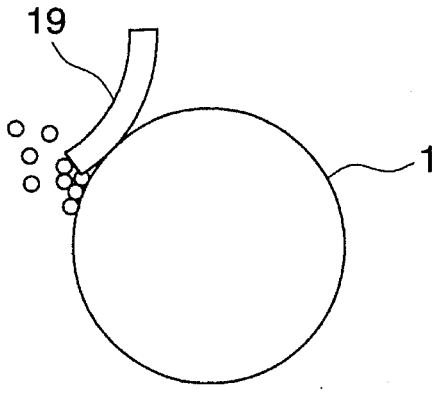
FIGS. 10(*a*) to 10(*c*) are schematic illustrations showing the generation process of blade development.
Figure 10:
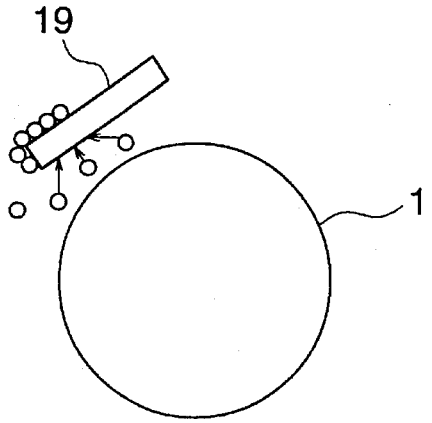
Figure 10:
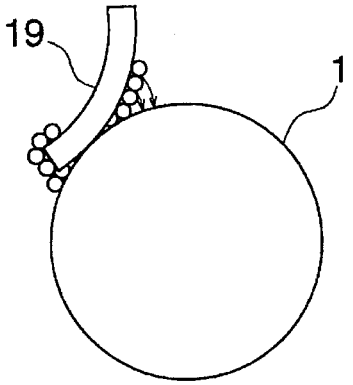

As illustrated in the side view of FIG. 8 and the charging diagram of FIG. 9, the external circumferential surface of the photoreceptor drum 1 of the electrophotographic color image forming apparatus of the present invention was divided into the image and non-image regions. Then, a latent image of lines, the size of which was 3 dots under the condition of 600 dpi, that is, the size was approximately 130 μm, was written in a portion that was 20 mm distant from the boundary between the image and non-image portions at the intervals of 5 dots. Writing was conducted in the non-image region each time. The electric potential gap $V_G$ was maintained at 200 V and 600 V. Contact of the blade was started at the fore end of the latent image.

Under the above conditions, the image forming apparatus of the present invention was tested and 10,000 sheets of recording paper were subjected to a running test. As a result, no blade development occurred in the image region.

However, in the case where a latent image pattern was not formed in the non-image region, the phenomenon of blade development occurred in the image region, especially in the edge of each image after about 100 sheets of recording paper had been subjected to printing.

According to the results of the test, the following were confirmed. It is preferable that the electric potential gap $V_G$ of the latent image pattern written in the non-image region of the photoreceptor is not less than 200 V. In order to provide more effect, it is more preferable that the electric potential gap $V_G$ is larger than that.

As explained above, the occurrence of blade development in the image region of the photoreceptor can be suppressed without installing the AC discharger. According to the present invention, it is possible to provide a highly reliable inexpensive image forming apparatus capable of stably forming a fine color image without any muddiness and stain.

What is claimed is:

1. A cleaning device for use in an image forming apparatus which includes an image carrier, an image forming means for forming a toner image on the image carrier, and a transfer means for transferring the toner image from the image carrier onto a recording sheet, in which the cleaning device cleans a residual toner on the image carrier after transferring, the cleaning device comprising;

(a) a cleaning blade for scraping off the residual toner on a circumferential surface of the image carrier;

(b) contacting means for bringing a tip end of the cleaning blade into contact with the circumferential surface of the image carrier in a direction upstream of a moving direction of the image carrier when a cleaning operation and the blade is conducted;

(c) releasing means for releasing the tip end of the cleaning blade from the circumferential surface; and (d) latent image pattern forming means for forming a latent image having a pattern, at a position where the tip end of the cleaning blade is in contact with an outside of an image forming area on the image carrier, the latent image pattern having a potential of not less than 200 volts, said potential being an absolute value of a difference between a DC bias voltage ($V_{DC}$) and a potential ($V_L$) on the image carrier after exposure thereof.

2. A cleaning device for use in an image forming apparatus which includes an image carrier, an image forming means for forming a toner image on the image carrier, and a transfer means for transferring the toner image from the image carrier onto a recording sheet, in which the cleaning device cleans a residual toner on the image carrier after transferring, the cleaning device comprising;

(a) a cleaning blade for scraping off the residual toner on a circumferential surface of the image carrier;

(b) contacting means for bringing a tip end of the cleaning blade into contact with the circumferential surface of the image carrier in a direction upstream of a moving direction of the image carrier when a cleaning operation and the blade is conducted;

(c) releasing means for releasing the tip end of the cleaning blade from the circumferential surface;

(d) latent image pattern forming means for forming a latent image having a pattern, at a position where the tip end of the cleaning blade is in contact with an outside of an image forming area on the image carrier; and (e) a controller for controlling the releasing means so that a releasing speed from the image carrier is less than 40 mm/ sec.

3. The cleaning device of claim 2, wherein, in the image forming apparatus, the toner image forming means repeats a process of a charging operation, an exposing operation and a developing operation for each of a plurality of color developing agents, so that a color toner image is superimposed and formed on the image carrier, and then a superimposed colored toner image is transferred onto a recording sheet at a time by the transfer means, and wherein the image forming apparatus further comprises a controller for controlling the releasing means so that the cleaning blade is released from the image carrier while the toner image forming means is forming a color toner image on the image carrier, and for controlling the contacting means so that the cleaning blade is brought into contact with the image carrier after the color toner image has been transferred onto a recording sheet by the transfer means at a time.

* * * * *